US005289671A

United States Patent [19]

Lerner et al.

[11] Patent Number: 5,289,671

[45] Date of Patent: Mar. 1, 1994

[54] PACKAGING MACHINE AND METHOD

[75] Inventors: Bernard Lerner, Aurora; Rick S. Wehrmann, Hudson; William M. Cronauer, Tallmadge, all of Ohio

[73] Assignee: Automated Packaging Systems, Inc., Twinsburg, Ohio

[21] Appl. No.: 954,305

[22] Filed: Sep. 30, 1992

[51] Int. Cl.[5] ..... B65B 57/08

[52] U.S. Cl. ..... 53/479; 53/75; 53/77

[58] Field of Search ..... 53/75, 77, 479, 477, 53/508, 507, 569, 505, 64; 156/583.1, 515

[56] References Cited

U.S. PATENT DOCUMENTS

| | | | |
|---|---|---|---|
| 1,962,742 | 6/1934 | Jongedyk . | |
| 2,082,210 | 6/1937 | McMaster . | |
| 2,320,346 | 6/1943 | Broekhuysen | 131/21 |
| 3,018,594 | 1/1962 | Phillips et al. . | |
| 3,355,857 | 12/1967 | Tobey . | |
| 3,564,809 | 2/1971 | Keramas | 53/75 X |
| 3,965,653 | 6/1976 | Lerner | 53/373 X |
| 4,541,233 | 9/1985 | Childers | 53/77 X |
| 4,899,520 | 2/1990 | Lerner et al. | 53/459 |
| 4,905,446 | 3/1990 | Dieckbernd et al. | 53/77 |
| 5,147,491 | 9/1992 | Thomas et al. | 53/75 X |

*Primary Examiner*—James F. Coan

*Attorney, Agent, or Firm*—Watts, Hoffmann, Fisher & Heinke Co.

[57] ABSTRACT

A jam prevention device comprises a light beam source that emits a light beam and is located on a main frame structure of a packaging machine in the machine's sealing section. During operation, the light beam is reflected off two reflective surfaces located on a moveable support operably connected to a prime mover. The reflected beam is received by a receiver located opposite the source. A clamping sub-assembly includes a seal bar and a reciprocatable seal pad housing. The housing is spring-mounted on the clamping sub-assembly and substantially surrounds the seal bar. The reflective devices are mounted on the housing. The prime mover moves the clamping sub-assembly towards a heater bar sub-assembly. The housing defines two cavities for receiving the reflective devices. The movement of the clamping sub-assembly brings a loaded bag into contact with the heater bar sub-assembly for the purpose of effectuating a seal of the bag. The pressure applied by the clamping sub-assembly during the meeting of the clamping sub-assembly and the heater bar sub-assembly causes the housing to move during the sealing process thereby moving the reflective devices into the cavities and disrupting the light beam. A photo-sensor is provided for detecting the reflection of the light beam during the sealing process as just described. Control structure either allows or disallows the sealing process to continue based upon detection of the light beam.

13 Claims, 6 Drawing Sheets

PACKAGING MACHINE AND METHOD

TECHNICAL FIELD

This invention relates to packaging machines, and more specifically to a packaging machine having an improved sealing section equipped with a jam prevention mechanism.

BACKGROUND

The use of chains of preopened plastic bags to form packages is now well known. Such chains of bags are disclosed and claimed in U.S. Pat. No. 3,254,828 entitled FLEXIBLE CONTAINER STRIPS (the Autobag Patent). A commercial version of a machine described and claimed in U.S. Pat. No. 3,965,653 entitled PACKAGING APPARATUS, and in other patents deriving from the applications that resulted in this patent, (the H-100 Patents) has been sold commercially by Automated Packaging Systems, Inc. under the designation H-100. With the very successful H-100 machine, bags of an interconnected chain are sequentially fed one at a time to a load station. Once a bag is positioned in the load station, a product is inserted and bag separation and sealing of the loaded bag is performed to provide a completed package.

A machine described and claimed in U.S. Pat. No. 4,899,520 entitled PACKAGING APPARATUS AND METHOD (the H-200 Patent) functions in a manner similar to the H-100 but has additional capabilities including the ability concurrently to utilize two chains of bags for "double up" packaging.

With the machines of the H-100 and H-200 patents loaded, bags are sealed at sealing stations each through contact with a heater bar which melts a portion of the plastic. During the sealing operation, the weight of a bag's contents and bag separation forces are isolated from the seal by spring-biased grippers which are moved into bag engagement by a clamping sub-assembly that concurrently brings the loaded bag into contact with the heater bar. All of these moving parts can be interfered with by a product that is only partially loaded or a foreign object thereby causing jams which can damage the machine and/or the product or can cause an improper seal which creates an unacceptable package.

SUMMARY OF THE INVENTION

The present invention provides a packaging machine having an improved sealing section. This sealing section has a simple yet effective jam prevention device that is useful in different situations for detecting jams or potential jams.

In the preferred embodiment, a packaging machine for loading bags includes a bag sealing section wherein the sealing section includes a frame structure and a light beam source mounted on the frame structure and adapted to emit an intermittent light beam. A heater bar is connected to the frame structure and located in close proximity to the light beam source. A reciprocatable support assembly is movably connected to the frame structure and includes a prime mover for causing reciprocation of the support assembly.

A clamping sub-assembly is connected to the support assembly. In use, the sub-assembly brings loaded bags into contact with the heater bar and clamps the loaded bag against the heater bar. The clamping sub-assembly includes a seal bar and a reciprocatable housing for the seal bar. The housing is spring biased to normally position the housing such that it substantially surrounds the seal bar.

Two reflective devices are located in the path of the light beam source for reflecting the light beam when emitted by the source. The reflective devices are located at opposite ends of the seal pad housing. A receiver is connected to the frame structure opposite the light beam source and receives the beam after reflection by the reflective devices.

An electronic control is provided for sensing reception of the reflected beam by the receiver and for controlling operation of the sealing section based upon such reception.

In the preferred embodiment, two cavities that serve as interrupters are defined within the clamping sub-assembly, one for each reflective device. Each reflective device enters its respective cavity upon reciprocation of the seal pad housing. The reciprocation of the seal pad housing occurs during contact between the heater bar and the clamping sub-assembly. When the reflective devices enter the cavities, the reflection of the light beam is disrupted by the cavities.

One of the outstanding features of the jam prevention mechanism of this invention is that it is functional both to sense the presence of a foreign object that may cause a jam and also to sense certain machine component failures. To accomplish this feature, light beam interruption during an initial portion of a sealing cycle indicating the presence of a foreign object will result in aborting of the seal cycle. Failure of the beam to be interrupted during a later portion of the cycle is an indication of a machine component failure and will also result in aborting of the cycle.

Thus, the jam prevention device operates to disrupt the operation of the sealing section whenever the light beam or its reflection is disrupted during an initial portion of support assembly motion during a sealing cycle. Undesired disruption of the light beam or its reflection can be caused by either a foreign object in its path or can occur by premature seal pad housing movement, causing the reflective devices to enter the cavities.

Once the clamping sub-assembly engages the heater bar, the housing shifts to cause the reflective devices to enter the cavities, and disrupt the light beam. This disruption is desirable because it is indicative of proper machine functioning, and the required meeting of the clamping sub-assembly and the heater bar has occurred. To this end, the electronic control includes a sensing device for sensing the meeting of the clamping sub-assembly and the heater bar. Once the meeting of the clamping sub-assembly and the heater bar sub-assembly is sensed, if the control structure does not sense the disruption of the light beam, the sealing process is interrupted. This feature of the jam prevention device also allows the electronic control to be monitored in that if the control "short circuits" and reception of the light beam is indicated when such reception is undesirable, the sealing process will be interrupted.

A microprocessor is utilized to determine if the two sub-assemblies have met in a predetermined amount of time. If they have not met within the predetermined amount of time, such as because an obstruction that is not disrupting the light beam is preventing meeting of the two sub-assemblies, the sealing process is interrupted.

Accordingly, the object of this invention is to provide a novel and improved packaging machine having an improved jam prevention device and a method of detecting obstructions and malfunctions in a packaging machine's sealing section.

DETAILED DESCRIPTION

Figure 1:
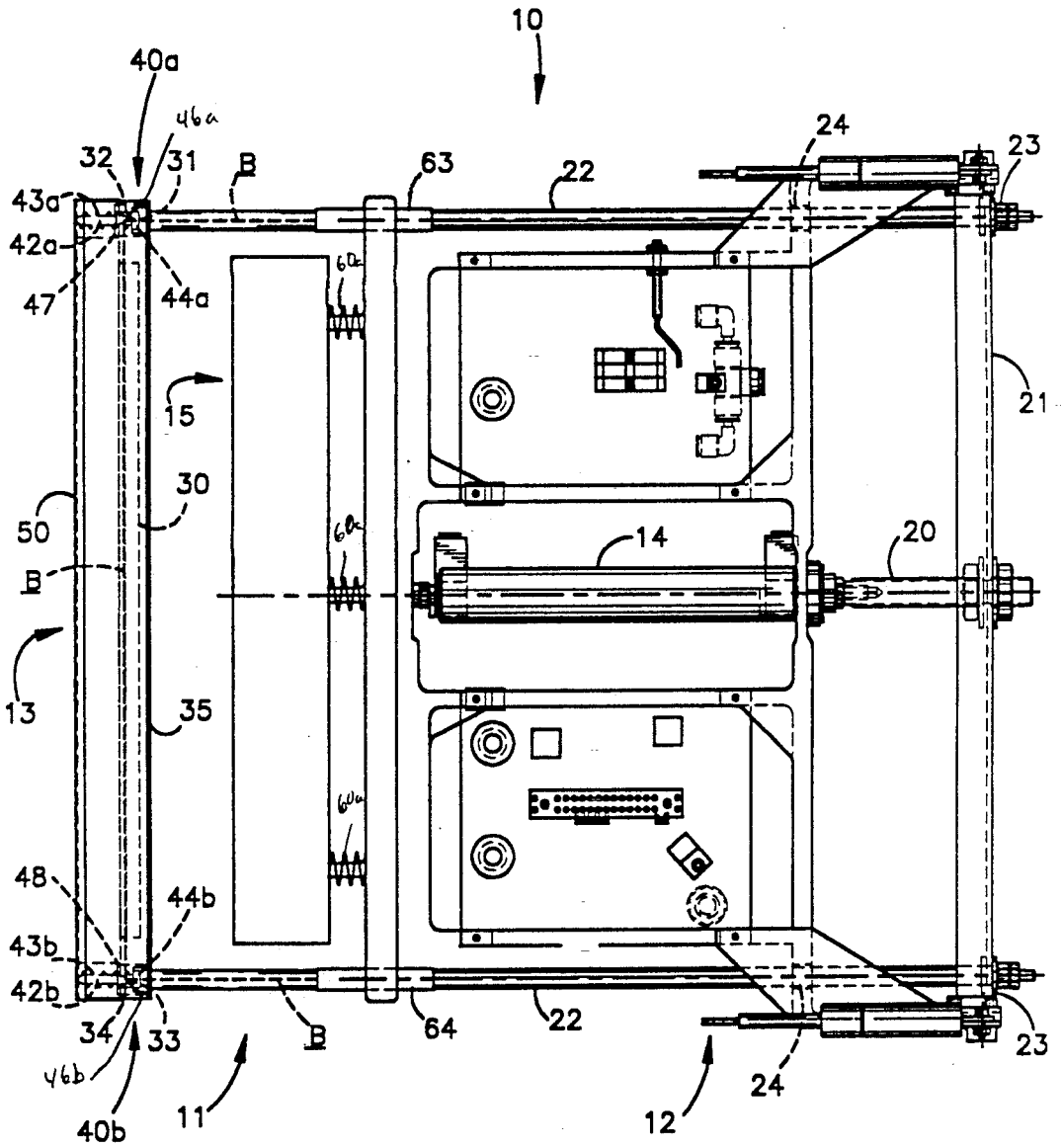
FIG. 1 is plan view of a packaging machine sealing section embodying the invention.
Figure 2:
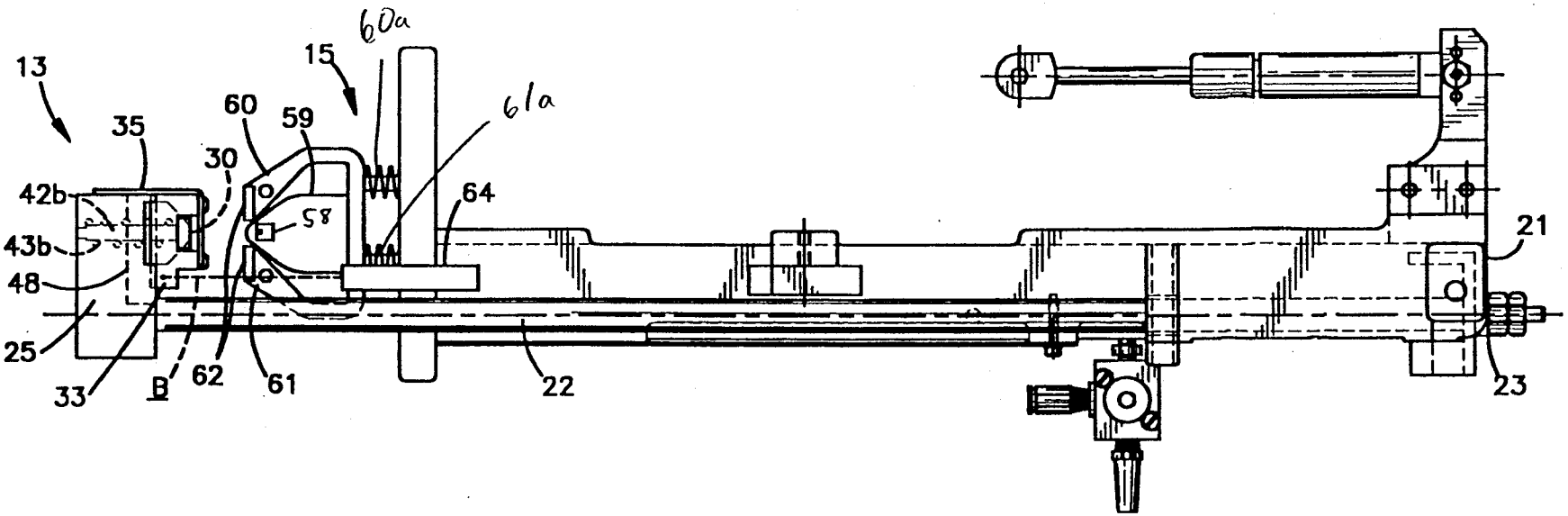
FIG. 2 is a side elevational view of the sealing section on an enlarged scale with respect to FIG. 1.
Figure 3:
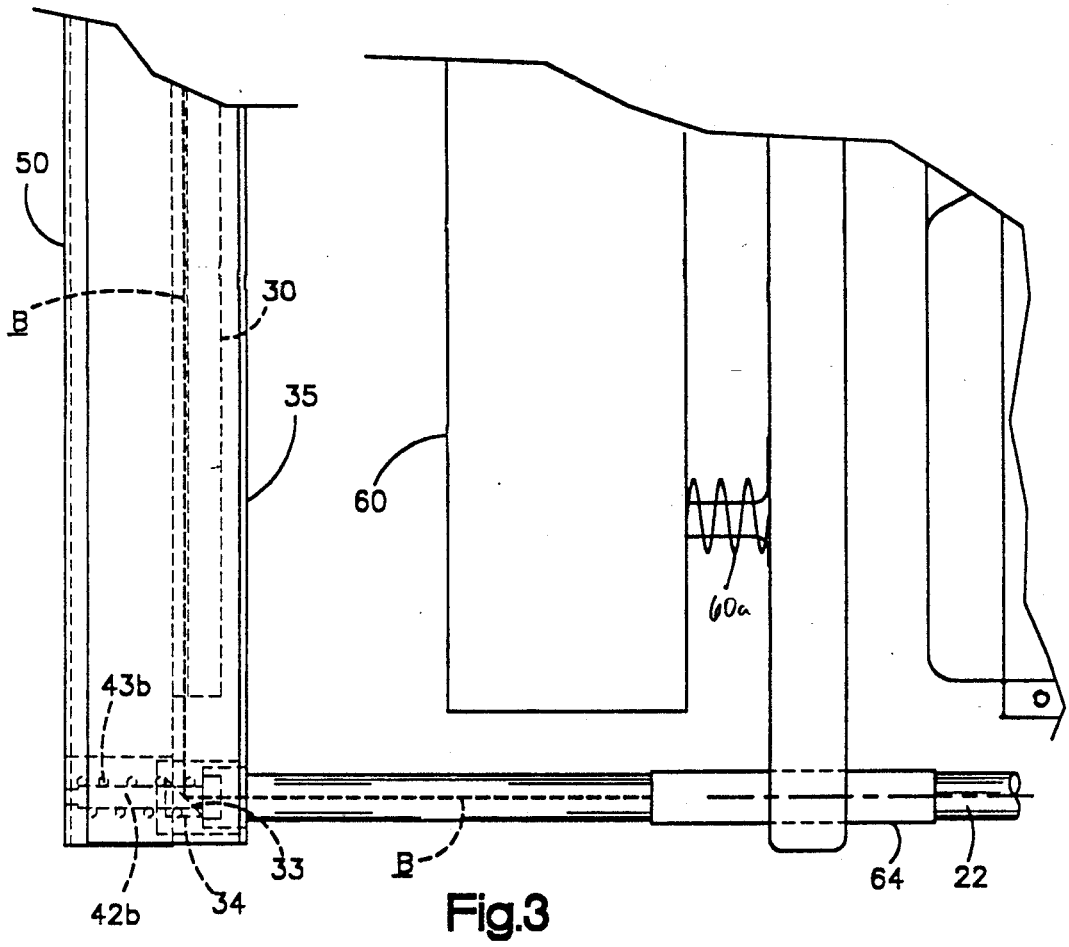
FIG. 3 is a still further enlarged fragmentary plan view of the sealing section.
Figure 7:
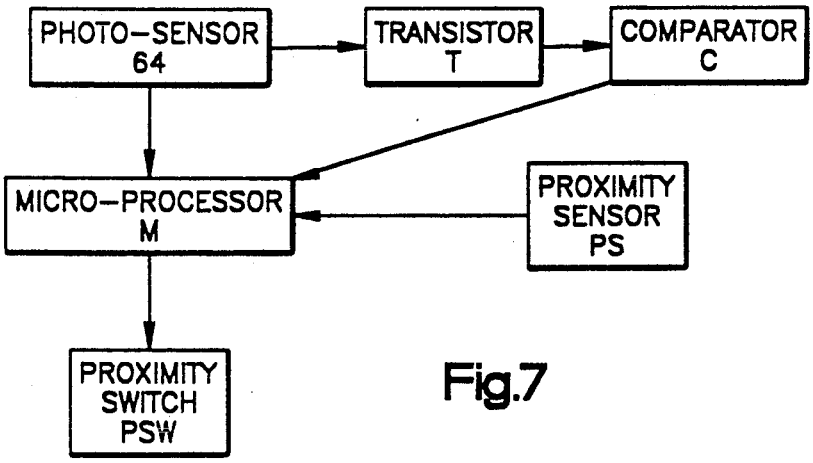
FIG. 7 is a flow chart illustrating a control system of a jam prevention system for a packaging machine sealing section embodying the invention.

Turing now to the drawings, portions of a packaging machine bagger 10 having a sealing section 11 and a frame structure 12 are illustrated. The sealing section 11 includes a clamping sub-assembly 13 connected to a prime mover, preferably in the form of an air cylinder 14. A heater bar sub-assembly 15 is connected to and mounted on the frame structure 12.

The packaging machine 10 is generally of the type described in a copending patent application owned by the present assignee, entitled "Packaging Machine," Ser. No. 07/954,378, and filed concurrently herewith. The co-pending patent application is incorporated herein in its entirety by reference. For purposes of this patent, only a lower sub-assembly of the packaging machine bagger 10 is illustrated.

The air cylinder 14 is mounted centrally of the frame 12. The cylinder includes an actuating rod 20. A channel-like cross member 21 is connected to the actuating rod 20. Guide rods 22 are secured near distal ends 23 of the cross member 21 and extend toward the front of the machine. The guide rods are slidably received (and supported) by bores 24 formed in the frame 12. Other bores (not shown) slidably receive the guide rods 22 and support the rods 22 near the front end of the machine 10. The clamping sub-assembly 13 extends between the front ends of the guide rods 22 so that when the prime mover 14 is energized to extend the actuating rod 20, the clamping sub-assembly 13 is pulled inwardly towards the heater bar sub-assembly 15.

The clamping sub-assembly 13 includes a sealing pad 30 connected to a support 25 which in turn is connected to the guide rods 22. A reflective device 31 is located at a corner end portion 32 of the support 25 and a second reflective device 33 is located at an opposite comer end portion 34.

A sealing bar housing 35 is connected to the support 25 via lost motion connections 40*a*, 40*b* and substantially surrounds the sealing pad 30. The lost motion connections 40*a*, 40*b* respectively comprise pins 42*a*, 42*b* and springs 43*a*, 43*b*. Each of the pins 42*a*, 42*b* has a corresponding head 44*a*, 44*b*. The springs 43*a*, 43*b* are mounted around the corresponding pins 42*a*, 42*b* between a back portion 50 of the housing 35 and the corresponding heads 44*a*, 44*b*. Each head 44*a*, 44*b* is located within an associated one of recesses 45*a*, 45*b* defined by the housing 35. The springs bias the housing 35 such that respective back portions 46*a*, 46*b* of the recess 45*a*, 45*b* normally engage a corresponding head 44*a*, 44*b*.

Figure 4:
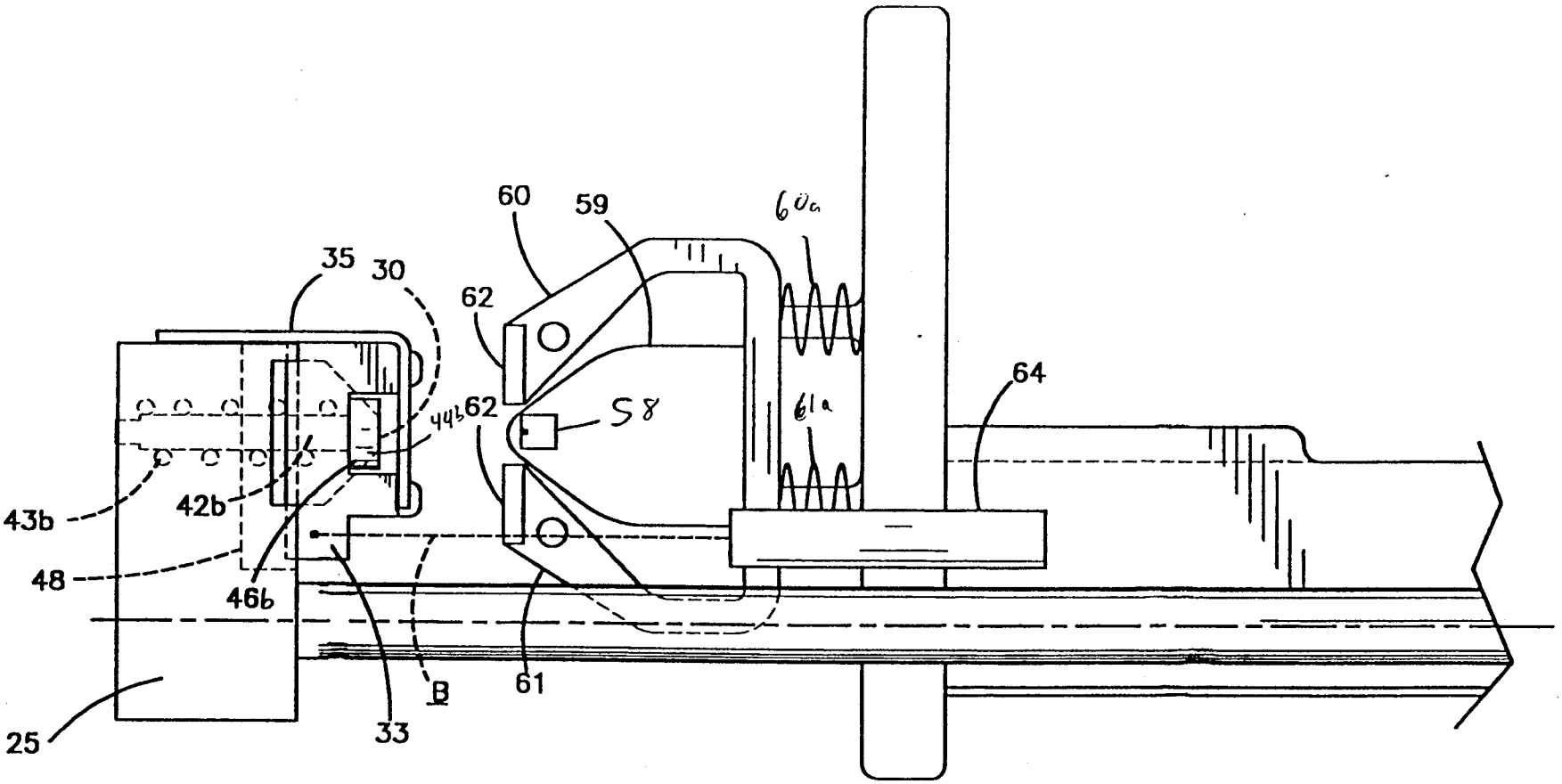
FIG. 4 is a still further enlarged fragmentary side view of the sealing section.
Figure 5:
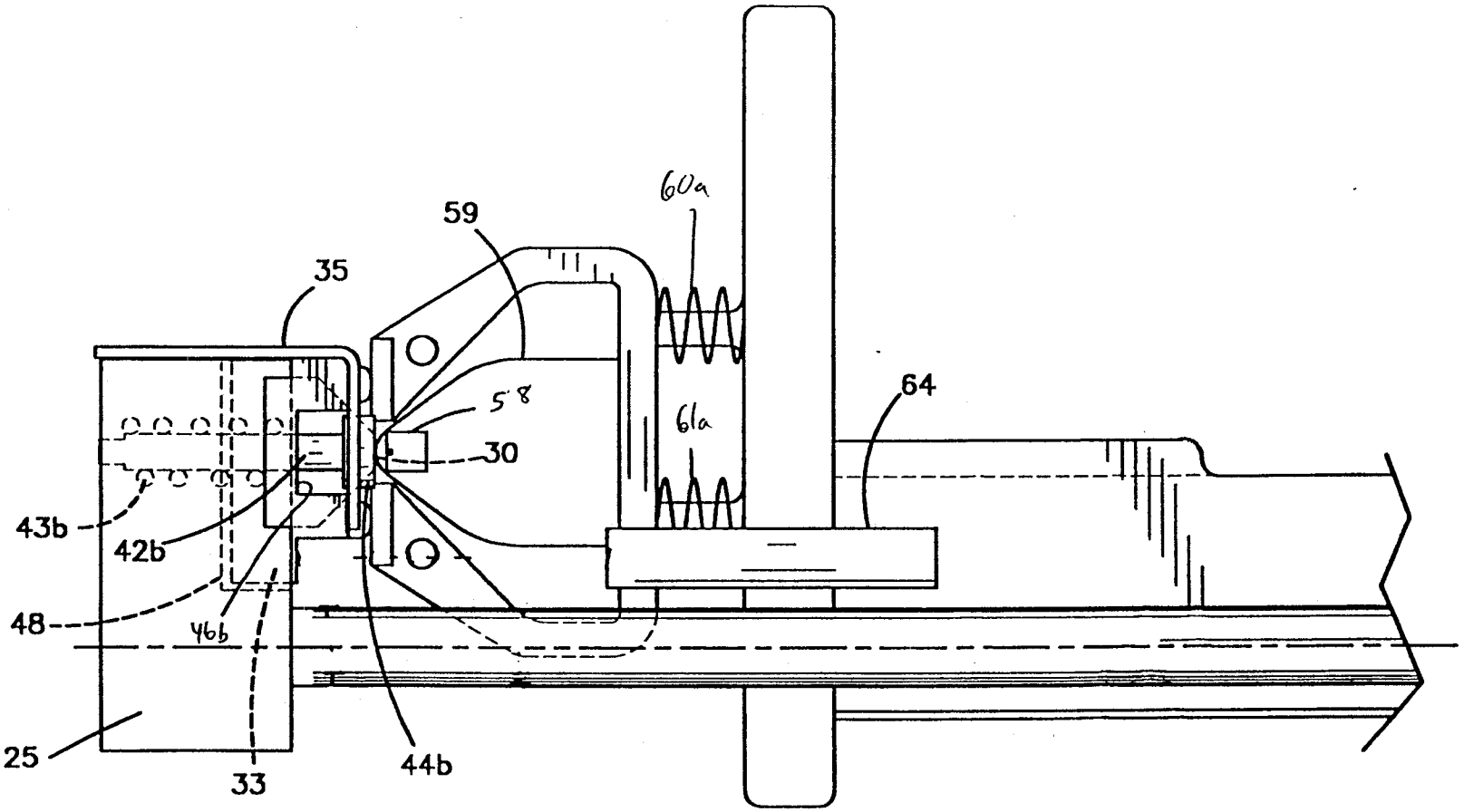
FIG. 5 is a fragmentary side view on the scale of FIG. 4 of the sealing section illustrate sub-assembly engaging a heater bar.

The support 25 defines two cavities 47, 48, respectively positioned to receive the reflective devices 31, 33. FIG. 4 illustrates the clamping sub-assembly prior to engaging the heater bar sub-assembly. FIG. 5 illustrates the clamping sub-assembly meeting the heater bar sub-assembly.

The heater bar sub-assembly 15 includes a heater bar 58 surrounded by a Teflon® cover 59 and upper and lower gripper plates 60, 61, which flank the heater bar. Each of the gripper plates 60, 61 has a flat surface 62 facing the clamping sub-assembly 13.

An infrared emitter 63 is connected to the frame 12. Preferably, the emitter emits a pulsed or intermittent signal with 15 microsecond pulses at 10 KHz. The emitter 63 serves as a light source which emits a light beam B direct toward the reflective device 31 along a beam path. The light beam B is reflected off of the reflective device 31, which is at a 45° angle relative to an incident portion from the emitter. The beam path is reflected 90° from the incident portion to a second path portion directed at the reflective device 33. The light beam is then reflected off of the reflective device 33, which is at a 45° angle relative to the second path portion of the beam path. An infrared receiver 64 is positioned to receive the beam after a second 90° reflection by the reflective device 33. The receiver is preferably in the form of a photo-sensor. The intermittent or pulsed form of the light beam allows the light beam to be distinguished from ambient light by the receiver 64.

Operation

As described in the co-pending application, in operation a chain of interconnected and preopened bags (not shown) is fed through the machine 10 to be loaded and sealed by the sealing section 11. Once a positioned bag is loaded, the prime mover 14 moves the clamping sub-assembly 13 towards the heater bar sub-assembly 15 in order to effect a seal of a loaded bag (not shown) by bringing the loaded bag into contact with the heater bar sub-assembly 15. The bag is clamped and held in place against the gripper plates 60, 61 by the sealing pad 30. The pressure of the clamping sub-assembly 13 shifts the plates 60, 61 against the action of springs 60*a*, 61*a* until the pad 30 forces the bag against the bar. In addition, the pressure exerted by the clamping sub-assembly 13 when it meets the heater bar sub-assembly 15 causes the sealing bar housing 35 to move along the lost motion connections 40, 41 as seen in FIG. 5. This moves the reflective devices 31, 33 into the cavities 47, 48 and disrupts the light beam.

During operation, the photo-sensor 64 receives the reflected light beam B and generates an output signal corresponding to reception or non-reception of the light beam. The photo-sensor's signal activates a transistor T. Output of the transistor is coupled to a comparator C that stretches the 15-microsecond light beam pulse to approximately 150 microseconds. If the reception of the light beam B is disrupted for any reason during an initial portion of a sealing cycle, such as obstruction of the light beam B by a foreign object or premature movement of the housing 35 via the lost motion connections, the photo-sensor signal causes the prime mover 14 to reverse its movement.

Upon the meeting of the clamping sub-assembly 13 and the heater bar sub-assembly 15, and thereby the movement of the housing 35 via the lost motion connections 40, 41, a microprocessor M operates to sense the proper movement of the housing 35. The microprocessor "knows" when the clamping sub-assembly 13 should have met the heater bar sub-assembly 15. The meeting is determined by a proximity sensor PS that senses movement of two relatively movable members. When the proximity sensor senses the clamping sub-assembly meeting the heater bar sub-assembly, output from a proximity switch PSW coupled to the microprocessor changes state. If the light beam is not disrupted at this point, thereby signalling a machine malfunction such as the failure of the housing 35 to move via the lost motion connections, the sealing operation is interrupted.

Once the loaded bag is sealed, the prime mover 14 moves the clamping sub-assembly 13 away from the heater bar assembly 15.

Additionally, if there is a machine malfunction such as if the transistor coupled to the output from the photosensor short-circuits causing the output to indicate that the light beam is present when it is not, the sealing cycle will be aborted. Thus, a failure not due to a problem with the sealing section 11, disables the sealing section because of the requirement for disruption of the light beam.

The microprocessor also monitors the output of the comparator. If the time period for pulsing drops below 150 microseconds, it is an indication a lens of the emitter 63 and/or a lens of the receiver 64 is dirty. A signal is then given to an operator to check and clean the lens.

Figure 6:
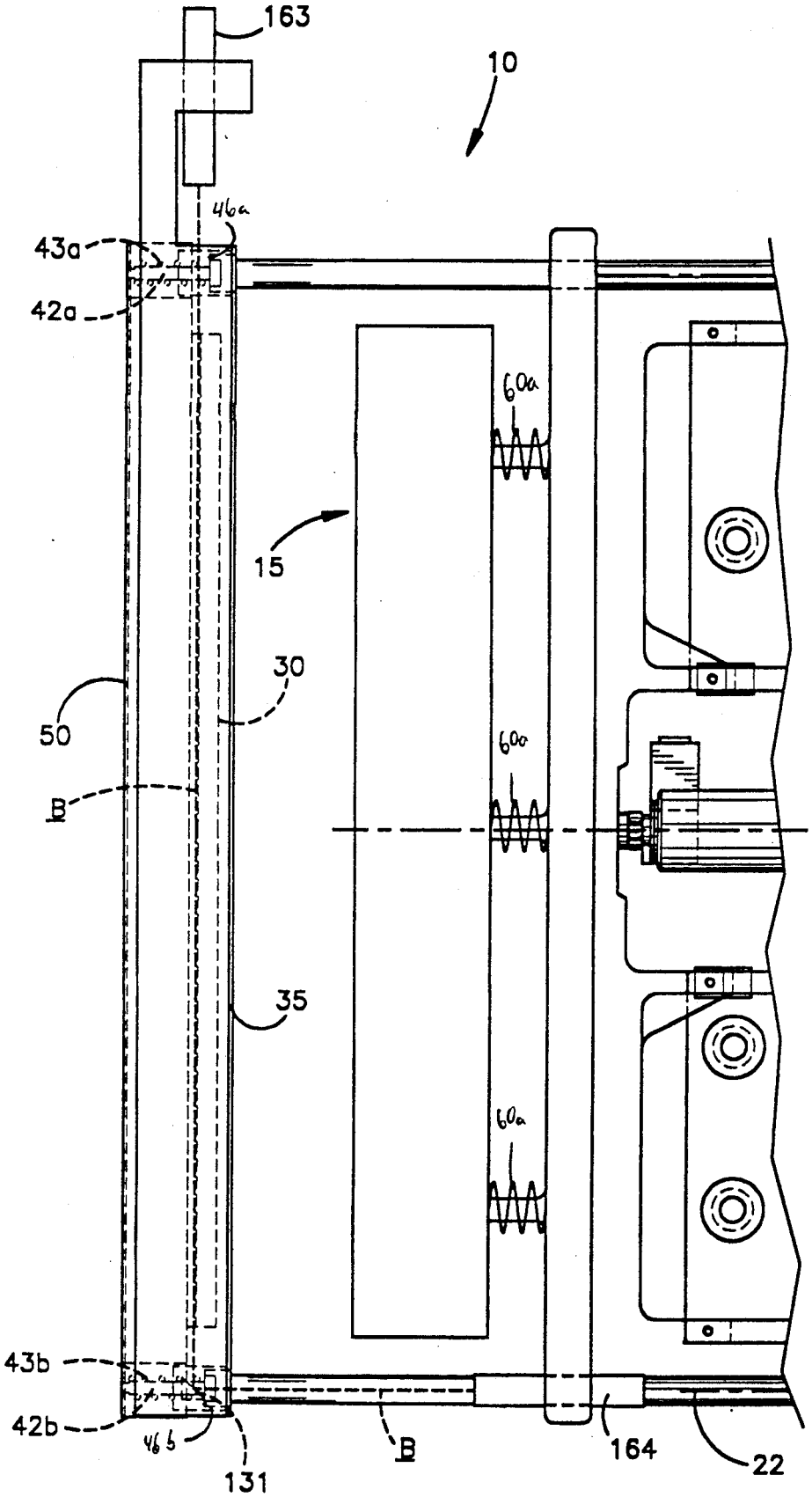
FIG. 6 is a fragmentary plan view of an alternative embodiment of the sealing section.

FIG. 6 discloses an alternative embodiment in which only one reflective device 131 is utilized. An infrared emitter 163 is mounted to the clamping sub-assembly. The emitter 163 is in alignment with the reflective device 131. The reflective device is at a 45° angle relative to the beam path from the emitter and reflects the light beam emitted by the emitter 163 towards an infrared receiver 164. Operation of the sealing section proceeds in the same manner as previously described for the preferred embodiment.

Although the preferred embodiments of this invention have been shown and described, it should be understood that various modifications and rearrangements of the parts may be resorted to without departing from the scope of the invention as disclosed and claimed herein.

What is claimed is:

1. A packaging machine for loading bags including a bag sealing section, the sealing section comprising:

a) a frame structure;

b) a light beam source mounted on the frame structure and adapted to emit a light beam along a path;

c) a heater bar and a seal bar each connected to the frame structure and located near a segment of the light beam path;

d) a reciprocatable housing for a selected one of the seal bar and heater bar;

e) a reciprocatable support movably connected to the frame structure and including a prime mover, the support carrying a selected one of the bars and being adapted to bring the bars together and thereby clamp a loaded bag against the heater bar;

f) at least one reflective device connected to the housing and located in the path of the light source beam for reflecting such light beam when emitted by the light beam source;

g) a receiver for receiving a reflection from the reflective device;

h) control means for sensing reception of the reflection by the receiver and controlling operation of said bag-sealing section based upon such reception;

i) the support defining at least one interrupter, there being one interrupter for each reflective device, each interrupter interrupting the light beam upon reciprocation of the housing during contact between the heater bar and seal bar; and, j) a sensing device for sensing the beam interruption.

2. The packaging machine of claim 1 wherein there are two reflective devices and two cavities defined within the support that serve as the interrupters, a first reflective device being located in line with the light beam source, a second reflective device being located to deflect a light beam received from the first reflecting device to the receiver, the source emitting a light beam that is, unless interrupted by the cavities or a foreign object, reflected by the first reflective device to the second reflective device that then reflects the light beam to the receiver.

3. A method of interrupting operation of a packaging machine during a sealing operation comprising:

a) directing a light beam from a source connected to one component of the sealing mechanism against a reflective surface on another component of the sealing mechanism;

b) actuating a prime mover to move the components relatively toward one another into engagement with portions of a package being formed and thereby compress the portions between a hot element and a seal pad respectively forming portions of the components;

c) detecting reflections of such beam with a light beam receiver as the prime mover is actuated; and d) interrupting the prime mover actuation causing relative component movement toward one another if the light beam receiver ceases to receive beam reflections during a predetermined portion of the component relative movement.

4. The method of claim 3 wherein said another component includes a lost motion connected part and the reflection detection step determines when the lost motion connected part has moved via the lost motion connection.

5. The method of claim 3 including the step of interrupting the operation of the prime mover to cause relative component movement toward one another if the receiver continues to receive beam reflections during a second predetermined portion of the component relative movement.

6. In a machine having a housing and frame structure and adapted to sequentially load and seal bags of a chain of interconnected and preopened bags, an improved sealing assembly comprising:

a) a heater bar element connected to the structure;

b) a sealing pad support connected to the structure and a sealing pad element carried by the support;

c) a prime mover operatively connected to and interposed between the elements for effecting relative motion between a storage position wherein the elements are spaced to a sealing position wherein a bag to be sealed is compressed between the elements;

d) a mechanism including two reflective surfaces connected to one of the elements;

e) a light source positioned to impinge a light beam on a first of the reflective surfaces for reflection of the light beam onto a second of the reflective surfaces during an initial portion of the relative motion from the storage to the sealing portions;

f) a light beam receiver mounted opposite the second reflective surface and positioned to receive reflected light from the second surface during said initial portion of relative motion, the receiver being adapted to emit a signal when detecting such reflected light, and, g) control means operatively connected to the receiver and adapted to stop relative motion from the storage to the sealing position during such initial portion if the receiver ceases to emit a signal in response to detected light.

7. The machine of claim 1 wherein the mechanism includes structure to block the beam path during a later portion of such relative motion; the control means is also adapted to stop relative motion from the storage to the sealing position if the receiver does not cease to emit a signal indicative of beam reception during the later portion of such relative motion.

8. The machine of claim 6 wherein the mechanism is connected to the support by a lost motion connection.

9. A package sealing mechanism comprising:

a) housing and frame structure;

b) relatively moveable heater bar and seal pad sub-assemblies connected to the structure;

c) a prime mover operably connected to the sub-assemblies selectively to cause relative sub-assembly motion from a spaced package receiving and discharge position to a package sealing position and return;

d) a light source and a spaced light receiver forming a part of the mechanism and positioned such that a beam emitted by the source along a beam path is received by the receiver under at least certain conditions;

e) a beam disrupter movably mounted on one of the sub-assemblies and shiftable between a beam disruption position blocking the path and a beam passage position spaced from the path; and f) control means operably connected to the receiver and the prime mover and adapted to abort a sealing operation in response to signals from the receiver indicating an undesired light beam condition.

10. The mechanism of claim 9 wherein the undesired condition during an initial portion of the motion from the receiving to the sealing position is beam interruption and during a later portion of such motion the lack of beam interruption.

11. In a machine having a housing and frame structure and adapted to sequentially load and seal bags of a chain of interconnected and preopened bags, an improved sealing assembly comprising:

a) a heater bar mounted on the structure;

b) the assembly including a mounted sealing pad support and a sealing pad carried by the support;

c) a prime mover operatively connected to the support and to the heater bar for effecting relative motion between a storage position wherein the pad is spaced from a sealing position wherein a bag to be sealed is compressed between the pad and the heater bar;

d) the support including two reflective surfaces;

e) a light source carried by the structure and positioned to impinge a light beam on a first of the reflective surfaces which reflects the light beam onto a second of the reflective surfaces when the prime mover is in the storage position and during an initial portion of the relative motions of the support from the storage to the sealing portions;

f) a light beam receiver mounted on the support opposite the second reflective surface positioned to receive reflected light from the second surface when the prime mover is in the storage position, the receiver being adapted to emit a signal when detecting such reflected light, and, g) control means operatively connected to the receiver and adapted to stop relative motion from the storage to the sealing position during such initial portion if the receiver ceases to emit a signal in response to detected light.

12. A packaging machine for loading bags including a bag sealing section, the sealing section comprising:

a) a frame structure;

b) a light beam source mounted on the frame structure and adapted to emit an intermittent light beam;

c) a heater bar connected to the frame structure;

d) a reciprocatable support assembly movably connected to the frame structure and including a prime mover;

e) a clamping sub-assembly connected to the support assembly for bringing a loaded bag into contact with the heater bar and clamping the loaded bag against the heater bar, the clamping sub-assembly including a seal bar and a reciprocatable housing for the seal bar;

f) at least one reflective device located in the path of the light source beam for reflecting such light beam when emitted by the light beam source, the reflective device being mounted on the housing for the seal bar;

g) a receiver for receiving a reflection from the reflective device;

h) control means for sensing reception of the reflection by the receiver and controlling operation of said bag-sealing section based upon such reception;

i) a cavity defined within the clamping sub-assembly for each reflective device, each reflective device entering its respective cavity upon reciprocation of the housing during contact between the heater bar and the clamping sub-assembly thereby disrupting reflection of the light beam; and, j) a sensing device for sensing the clamping sub-assembly meeting the heater bar.

13. The packaging machine of claim 12 wherein there are two reflective devices and two cavities defined within the clamping sub-assembly, a first reflective device being located directly opposite the light beam source, a second reflective device being located directly opposite the receiver, the source emitting a light beam that is reflected by the first reflective device to the second reflective device that then reflects the light beam to the receiver.

* * * * *